United States Patent [19]

Pavone

[11] Patent Number: 4,468,017

[45] Date of Patent: Aug. 28, 1984

[54] VACUUM ZONE CONTROL VALVE

[75] Inventor: Robert J. Pavone, South Windsor, Conn.

[73] Assignee: The Gerber Scientific Instrument Company, South Windsor, Conn.

[21] Appl. No.: 375,982

[22] Filed: May 7, 1982

[51] Int. Cl.[3] ..... B25B 11/00

[52] U.S. Cl. ..... 269/21; 137/625.11

[58] Field of Search ..... 269/21; 51/235; 279/3 R; 137/625.11, 625.12; 251/297

[56] References Cited

U.S. PATENT DOCUMENTS

| | | | |
|---|---|---|---|
| 1,348,123 | 7/1920 | Muth | 137/625.11 |
| 2,335,085 | 11/1943 | Roberts | 137/625.11 |
| 2,834,376 | 5/1958 | Hughes | 137/625.11 |
| 3,096,788 | 7/1963 | Talbot et al. | 137/625.11 |
| 3,307,818 | 3/1967 | Cocito | 269/21 |
| 3,328,022 | 6/1967 | Miller | 269/21 |
| 4,065,982 | 1/1978 | Wenger | 137/625.11 |
| 4,131,267 | 12/1978 | Ono et al. | 269/21 |

FOREIGN PATENT DOCUMENTS

| | | | |
|---|---|---|---|
| 931756 | 3/1948 | France | 137/625.11 |
| 2024991 | 1/1980 | United Kingdom . | |

*Primary Examiner*—Robert C. Watson

*Attorney, Agent, or Firm*—McCormick, Paulding & Huber

[57] ABSTRACT

A manual control valve for installation in a vacuum system including a contiguously-zone vacuum table permits an operator to progressively increase or decrease the number of energized vacuum zones of the table. The valve includes a housing having an outlet securable to a vacuum source and a plurality of inlet passageways connectable with the table so as to communicate with the respective vacuum zones. A plug is rotatably received in the housing, and a network of passageways within the plug and housing interact upon rotation of the plug with respect to the housing to provide communication between the housing outlets and various ones of the housing inlets. The valve also includes indexing means by which the plug is releasably held in place at each of several rotational positions with respect to the housing.

8 Claims, 8 Drawing Figures

VACUUM ZONE CONTROL VALVE

BACKGROUND OF THE INVENTION

This invention relates generally to a vacuum holding system including a table having a workpiece engageable surface comprised of contiguous vacuum zones, and deals more particularly with a valve through which one or more of the vacuum zones in such a system are energized.

In the general type of vacuum system with which this invention is concerned, a vacuum table includes a workpiece engageable surface divided into contiguous vacuum zones. Each of the vacuum zones are in communication with a vacuum source through individual conduits, and valves are installed in the conduits to permit an operator to energize the zones individually. Examples of vacuum holding systems such as aforedescribed are embodied in sheet material holddown tables disclosed in U.S. Pat. Nos. 3,495,492 and 3,848,327. The number of conduit valves in each of these general types of systems is equal to the number of vacuum zones in the table and may represent a high proportion of the total cost of the holding system.

If the table in the system is mounted for movement in one or more coordinate directions relative to a fixed structure by means of a drive motor, it is desirable that the table be as light as possible because less power is required by the drive motor to move the table and there is less likelihood of positioning errors due to inertia effects. If several valves are carried by the table to effectuate the communication between the individual vacuum zones and the vacuum source, the table is necessarily heavy. If the valves are mounted off of the table, then the movement of multiple conduits with the table presents another problem.

Typically, the vacuum zones arranged adjacent one another on the surface of a contiguously-zoned table are progressively energized or de-energized to increase or decrease the effective holding area of the table surface. However, if one table zone which is desired to be energized in progression with adjacent zones fails to be energized due to valve failure or mere inadvertance, the fact that the zone is not energized may not be detected for some time.

It is accordingly an object of this invention to provide a single valve for use with a contiguously-zoned vacuum table for energizing one or more of the vacuum zones of the table.

It is a further object of this invention to provide a single valve suitable for attachment to a movable vacuum table in place of the several valves or multiple conduits carried by the table in the prior art and thereby reduce the weight of the table.

It is a still further object of this invention to provide a valve which allows an operator to reliably energize or deenergize in progression the vacuum zones of a contiguously-zoned vacuum table to increase or decrease the effective holding area of the table surface.

SUMMARY OF THE INVENTION

This invention resides in a valve and a valve installation in a vacuum system having a vacuum source and at least two vacuum zones.

The valve includes a housing having an outlet end securable to the vacuum source and defining a central through-opening extending from the outlet end of the housing, and a plug having a portion rotatably received within the through-opening of the housing for rotation of the plug with respect to the housing. The housing defines a plurality of radially extending passageways between the housing through-opening and the housing exterior. Each passageway, opening to the exterior of the housing, is securable to a respective vacuum zone. The plug has a cavity defined therein which opens to the outlet end of the housing. If a plug is in a first angular position with respect to the housing, the cavity provides an airflow path from one housing passageway through the outlet end of the housing, and if the plug is in a second angular position with respect to the housing, the cavity provides an airflow path from two housing passageways through the outlet end of the housing.

Installed in a vacuum system between the vacuum source and the vacuum zones, the valve provides a single control device through which one or more of the vacuum zones may be energized. When the plug is in the first angular position with respect to the housing as outlined above, one vacuum zone is energized, and when the plug is in the second angular position, two vacuum zones are energized.

DETAILED DESCRIPTION OF THE PREFERRED EMBODIMENTS

Figure 1:
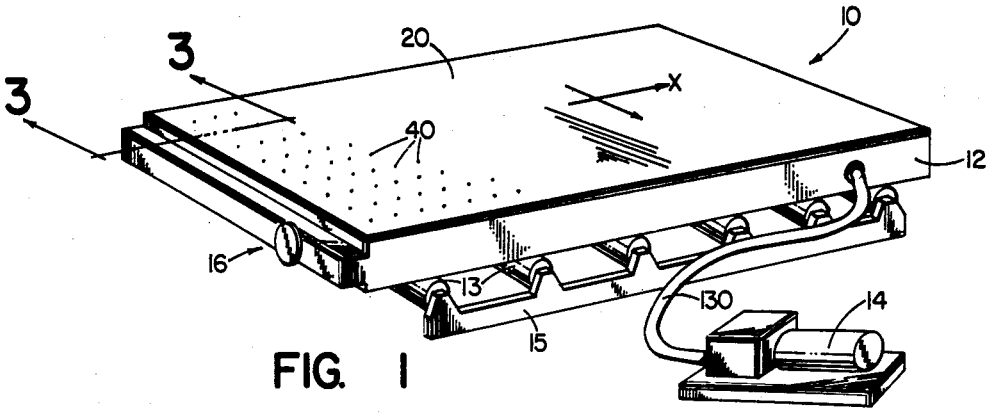
FIG. 1 is a perspective view of a vacuum table system in which the present invention is utilized.

FIG. 1 shows a vacuum holding system, generally designated 10, which provides a typical environment for the present invention. The system includes a vacuum table 12 and a vacuum source or pump 14. The table 12 defines a flat workpiece engageable surface 20 against which a workpiece, such as a piece of plotting paper, having a smooth, flat bottom surface is placed to be held against the table surface by the vacuum pump 14. The table surface 20 is comprised of a plurality of contiguously-arranged vacuum holding zones. Several of the vacuum zones communicate with the vacuum pump 14 through a control valve of this invention, indicated at 16, and may be energized or deenergized by adjustment of the valve.

The vacuum table 12 is movably supported on a plurality of rollers 13, 13 attached to a frame structure 15 fixed stationary relative to the earth. The ends of each roller are journaled within the frame structure 15 so that the rollers may rotate freely as the table is moved fore and aft in the illustrated X-coordinate direction. Since the frame structure 15 is stationary relative to the earth, the movable table 12 is well suited for use with a tool or instrument that is stationary or movable in the Y-coordinate direction. A machine utilizing such a movable table is described in my copending U.S. application Ser. No. 375,981, filed May 7, 1982 and entitled DUAL-AXIS, SINGLE MIRROR INTERFEROMETER MEASURING SYSTEM.

Figure 2:
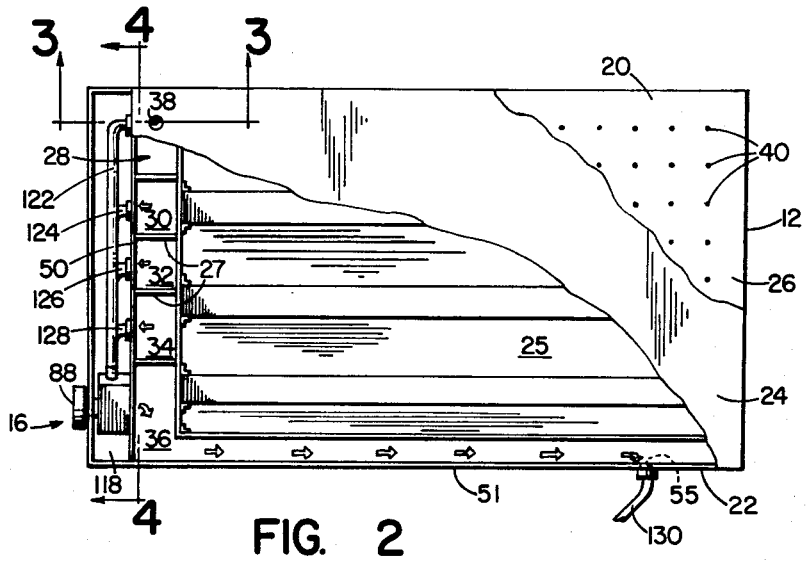
FIG. 2 is a top plan view of the vacuum table of FIG. 1 having portions cut-away to expose airflow compartments within the table and a control valve according to this invention.
Figure 3:
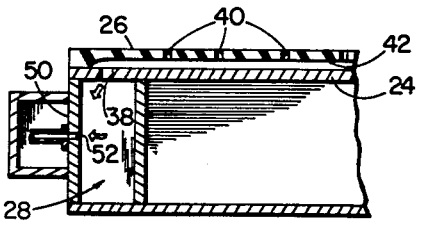
FIG. 3 is a cross-sectional view as seen along line 3—3 of FIGS. 1 and 2.
Figure 4:
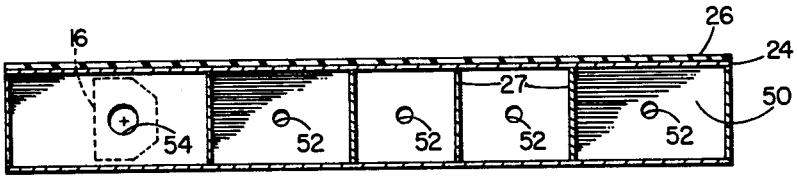
FIG. 4 is a cross-sectional view as seen along line 4—4 of FIG. 2.

Referring to FIG. 2, the vacuum table 12 of the system is comprised of a frame 22 and a foraminous platen 26 overlying the frame. The frame 22 is constructed of metal and includes a structural arrangement of channels and bracework sandwiched between an upper metal sheet 24 and a lower metal sheet 25. Together the metal sheets and bracework define a plurality of airflow compartments 28, 30, 32, 34 and 36 as shown. Each compartment is separated from its adjacent compartment by a bracework partition 27. Referring to FIGS. 2, 3, and 4, air is permitted to enter each of four compartments 28, 30, 32 and 34 through one of five holes 38 (only one shown) defined in the upper metal sheet 24 and communicating with a respective compartment 28, 30, 32, 34 or 36, and air is permitted to leave the compartments 28, 30, 32 and 34 through one of four holes 52, 52 defined in a frame piece 50 forming a sidewall of the compartments. Air is permitted to enter the remaining compartment 36 through the remaining hole 38 defined in the upper metal sheet 24 and a hole 54 defined in the frame piece 50 and is permitted to leave the compartment 36 through a hole 55 in a frame piece 51 forming a side of the table. As will be described in more detail hereinafter, the valve 16 has four inlets which communicate with an associated frame compartment 28, 30, 32 or 34 through one of the holes 52, 52 in the frame piece 50 and has one outlet which communicates with the frame compartment 36 through the frame piece hole 54.

Figure 5:
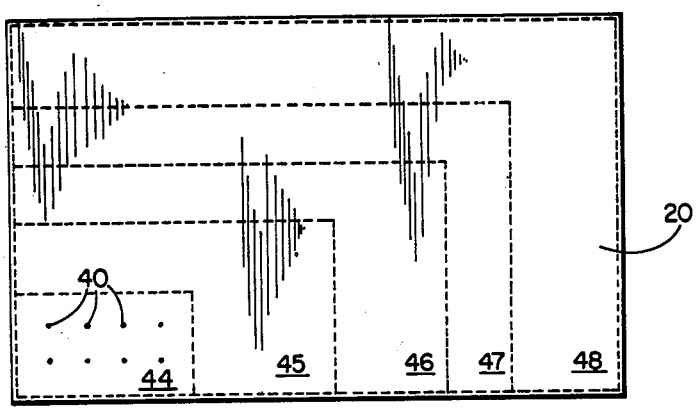
FIG. 5 is a top plan view of the foraminous platen positioned atop the vacuum table of FIG. 1.

Referring to FIGS. 3 and 5, the foraminous platen 26 defines five vacuum zones 44, 45, 46, 47 and 48. Each of the five zones is provided with a plurality of holes 40, 40 dispersed over the surface of each zone and communicating with grooves defined on the underside of the platen. Through a hole 38 in the metal sheet 24 and airflow paths 42 defined by the platen grooves, the holes of each zone communicate with an associated frame compartment. Specifically, zone 44 communicates with frame compartment 36, zone 45 communicates with compartment 34, zone 46 communicates with compartment 32, zone 47 communicates with compartment 30, and zone 48 communicates with compartment 28.

Figure 7:
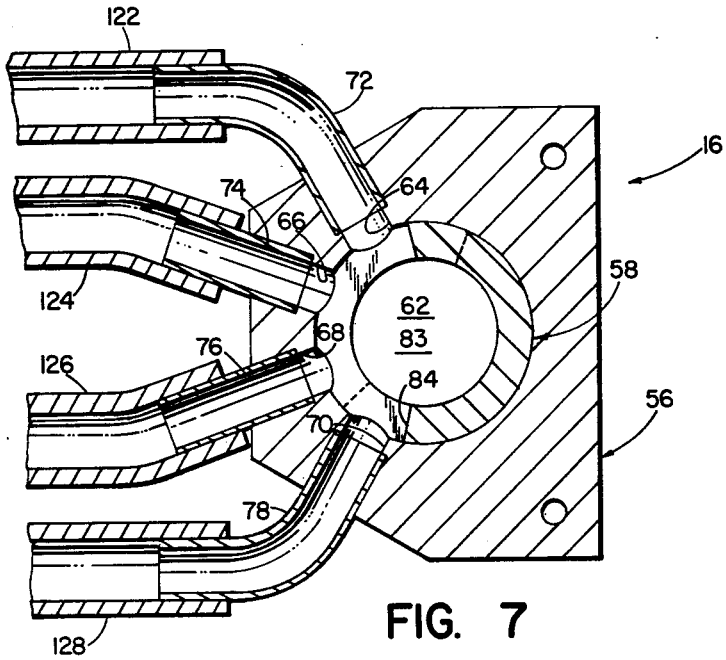
FIG. 7 is a cross-sectional view as seen along line 7—7 of FIG. 8.
Figures 6, 8:
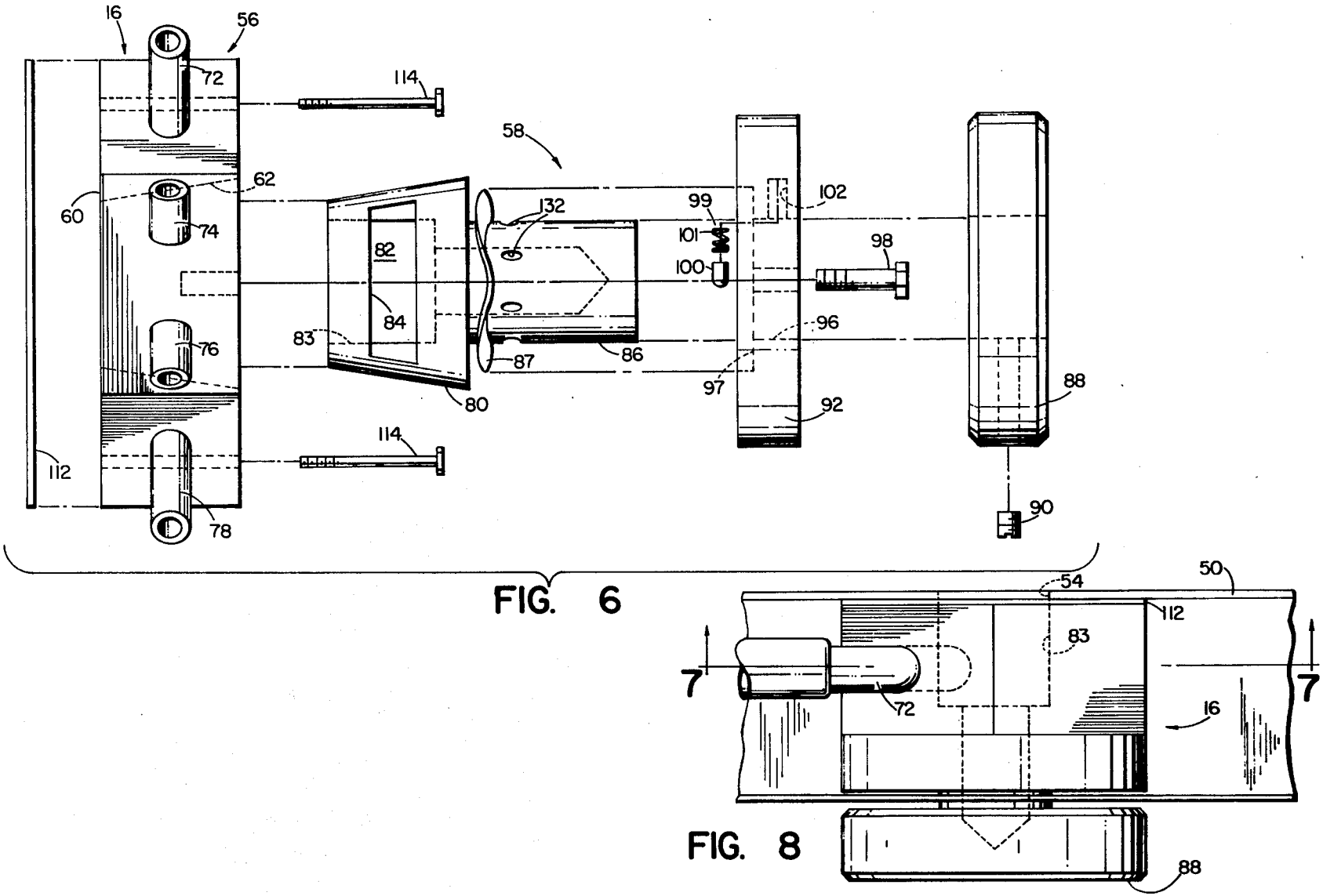
FIG. 6 is an exploded view showing one embodiment of the control valve of this invention.
FIG. 8 is a top plan view of the control valve as seen installed in the FIG. 2 table but drawn to a slightly larger scale.

In accordance with this invention and referring to FIGS. 6 and 7, the control valve 16 of this invention includes a housing, indicated generally 56, and a plug, indicated generally 58. The housing defines an air outlet end 60 and a conically-shaped central through-opening 62 extending from the outlet end 60 with its conical shape opening away from the outlet end. As best shown in FIG. 7, the housing also defines four radially extending passageways 64, 66, 68 and 70 between the housing through-opening 62 and the housing exterior. The housing passageways are arranged circumaxially along the surface of the through-opening. Metal sleeves 72, 74, 76 and 78 are press fitted in the housing passageways with a portion of the sleeves extending from the housing. Each of the sleeve portions extending from the housing is securable to a vacuum hose and serves as an air inlet of the valve 16.

The plug 58 includes a conical-shaped end portion 80 mating with and rotatably received in the housing through-opening 62. The plug has a cavity 82 defined in part by a center bore 83 extending from the end of the plug associated with the outlet end 60 of the housing 56 and defined in part by a passageway 84 communicating with the plug center bore 83 and the plug exterior. The plug passageway 84 is in the form of a slot and, as best seen in FIG. 7, permits each of the housing passageways to communicate with the center bore 83 of the plug when the plug is rotated to a particular angular position with respect to the housing.

Referring to FIG. 6, the plug 58 also includes a knobbed end portion opposite the conical-shaped end portion 80 comprised in part by a cylindrical portion 86 and in part by a knurled knob 88. The cylindrical portion 86 and knob 88 are joined together to permit an operator to rotate the plug 58 with respect to the housing 56. Other components of the valve 16 illustrated in FIG. 6 include a wave spring washer 87 and a cup-shaped cap 92, each used to hold the plug and housing together. The cup-shaped cap 92 is characterized by a through-bore 96 and a recessed surface 97 defined therein and, during assembly of the valve, the cap is placed over the cylindrical portion 86 of the plug so that its recessed surface 97 flushly engages the wave washer 87. The cap 92 is then attached to the housing 56 by means of two screws 98 (only one shown). Acting between the plug and the cap 92, the washer 87 biases the plug into the housing through-opening 62 to promote sealing between the plug and housing. The knob 88 is thereafter placed over the cylindrical plug portion 86 and secured thereto by a set screw 90 to complete the assembly of the valve.

In FIG. 7, the plug is shown in an angular position with respect to the housing at which the slotted passageway 84 of the plug cavity 82 aligns with all of the housing passageways. At this angular position, continuous airflow paths are provided from all of the valve inlets, provided by the metal sleeves 72, 74, 76 and 78, through the outlet end 60 of the housing by way of the plug center bore 83. When the plug is rotated slightly clockwise as viewed in FIG. 7 so that the slotted passageway 84 of the plug cavity moves to its phantom line position, only three valve inlets, provided by sleeves 72, 74 and 76, communicate with the center bore 83 of the plug cavity. It can be seen that the plug may be rotated still further clockwise to another angular position with respect to the housing enabling only two valve inlets, provided by the sleeves 72 and 74, to communicate with the plug center bore 83, and similarly, the plug may be rotated to still another angular position enabling only one valve inlet, provided by the sleeve 72, to communicate with the plug center bore. It can also be seen that there exists an angular position of the plug with respect to the housing at which the slotted passageway 84 of the plug cavity fails to communicate with any of the valve inlets and at that position, no air is permitted to pass between the valve inlets and the plug center bore.

The valve 16 also includes indexing means cooperating between the plug and the housing for releasably holding the plug in place at each of its angular positions with respect to the housing. Referring to FIG. 6, the indexing means includes means defining a series of detents positioned circumaxially about the axis of plug rotation and a spring and plunger assembly, indicated 99. The detents are in the form of grooves 132, 132 defined on the surface of the cylindrical portion 86 of the plug and spaced from one another around the plug periphery. The spring and plunger assembly 99 includes a plunger 100 being rounded on one end and flat on the other and a compression spring 101. A circular recess 102 is defined in the cup-shaped cap 92 and of such shape to loosely receive the spring 101 and plunger 100. When the valve 16 is assembled and the plunger and spring are positioned in the cap recess 102, the spring acts between the base of the recess 102 and the flat end of the plunger to bias the plunger into engagement with the cylindrical plug portion 86. As the plug 58 is rotated with respect to the housing 56, the spring compresses or expands to allow the plunger to move in and out of the cup-shaped cap as the round end of the plunger smoothly slides along the surface of the plug portion 86. The grooves, the spring and plunger assembly 99, and the slotted passageway 84 of the plug cavity are arranged in relation to one another so that the plunger is received in a groove 132 when the plug is in each of its respective angular positions at which four, three, two, one or none of the housing inlets communicate with the plug center bore 83.

The force required to rotate the plug varies as the plunger slides along the surface of the cylindrical plug portion 86 due to the expansion or contraction of the spring 101. The greatest force required to rotate the plug between detent positions must be applied when the spring 101 is in its extended condition, or when the plunger is received within a groove 132 so that as the plug is indexed between angular positions with respect to the housing, the plug is releasably held in place when the plunger 100 slides to the middle of a groove and the spring 101 is in its extended condition.

Referring to FIGS. 2, 4 and 8, the valve 16 is shown installed in the table 12 against the frame piece 50 so that the plug center bore is in coaxial alignment with the hole 54 defined in the frame piece. Through the hole 54, the plug cavity communicates with the frame compartment 36. The sealing gasket 112 is positioned between the housing of the valve and the frame piece 50 to enhance the air seal therebetween, and the valve is secured to the frame piece 50 by screws 114, 114 of FIG. 6. As best shown in FIG. 2, the valve 16 is substantially enclosed in one frame compartment 118 while the knobbed end portion of the plug extends through a hole defined in an end piece 120 of the frame 22. The knob 88 is thereby accessible to an operator.

Referring to FIGS. 2, 5 and 7, each of four frame compartments 28, 30, 32 and 34 communicates with the valve inlets by way of the hoses 122, 124, 126 and 128, respectively. One end of each of the hoses aligns with a respective hole 52 opening into one of the frame compartments, and the other end is snuggly secured to a respective valve inlet, or metal sleeve 72, 74, 76 or 78.

When the vacuum pump 14 is energized, a vacuum is drawn in one frame compartment 36 by way of the conduit 130 connected between the pump and the hole 55 of the table frame 22. Since one table vacuum zone 44 is in continual communication with the frame compartment 36, the vacuum zone 44 is energized any time that the pump is energized. On the other hand, the remaining table zones 45, 46, 47 and 48 must communicate with the frame compartment 36, if at all, through the valve 16. Therefore, rotation of the plug to various angular positions with respect to the housing energizes or de-energizes the remaining table zones as the slotted passageway 84 of the plug cavity moves into and out of alignment with the valve inlets.

The valve zones are connected to the valve inlets so that adjacent zones are energized in progression to increase the effective holding area of the table surface. More specifically and with reference to FIGS. 5 and 7, zone 45 is in communication with the valve inlet provided by the metal sleeve 78, zone 46 is in communication with the valve inlet provided by the sleeve 76, zone 47 is in communication with the valve inlet provided by the sleeve 74, and zone 48 is in communication with the valve inlet provided by the sleeve 72. Therefore, rotation of the plug clockwise as viewed in FIG. 7 from its angular position at which no inlets communicate with the valve outlet through the plug cavity, energizes zone 45, 46, 47 and 48 in progression until the plug reaches its solid line position. Zone 45 is energized at one angular position of the plug with respect to the housing, zones 45 and 46 are energized at another angular position, zones 45, 46 and 47 are energized at still another, and all the zones are energized in a further position. As best shown in FIG. 7, such progressive energizing increases the effective holding area of the table from the lower left-hand portion of the table surface 20. Counter-clockwise rotation of the plug from its solid line position progressively de-energizes the zones 48, 47, 46 and 45 to decrease the effective holding area of the table.

It will be understood that numerous modifications may be had to the aforedescribed embodiment of the valve 16 without departing from the spirit of the invention. For example, although the housing of the valve 16 has been described as having four radially extending passageways, there may be as few as two such passageways and the valve would still be in accordance with the broader aspects of the invention. Furthermore, when the valve is utilized in a system as aforedescribed, the low-pressure region created at the valve outlet by the vacuum pump supportedly holds the plug within the housing and forms an effective seal between the plug and housing as the conical-shaped surfaces of the plug and housing are drawn in snug-fitting engagement, and thus the need for means for holding and sealing the plug and housing together, such as the spring wave washer 87 and the cup-shaped cap 92, is obviated. Accordingly, the embodiments described herein are intended as illustration and not as limitation.

I claim:

1. In a vacuum holding system having a table defining a workpiece engageable surface divided into contiguous vacuum zones from which individual conduits extend, each individual conduit being associated with a respective vacuum zone, and a vacuum source from which a single conduit extends, the improvement comprising:

a housing having an outlet end adapted to be secured to the single conduit extending from the vacuum source, and a central through-opening extending along an axis through the housing from the outlet end of the housing, the through-opening having a conically shaped portion with the smaller end of the conical shape being located adjacent the outlet end of the housing, the housing defining a plurality of radially extending passageways between the conically shaped portion of the through-opening and the housing exterior, the passageways each having an inlet opening at the exterior of the housing and secured to an individual conduit associated with a respective vacuum zone, and a plug having a conically shaped portion rotatably received in sealing relationship with the conically shaped portion of the central through-opening of the housing when vacuum from the pump operates on the valve and pulls the plug toward the outlet end of the housing, the plug being supported in the housing for rotation between a plurality of angular positions with respect to the housing, the plug including a knobbed end opposite the outlet end of the housing to permit an operator to rotate the plug relative to the housing, the plug having a central cavity defined therein and communicating with the outlet end of the housing and through the conically shaped portion of the plug with a first of the housing passageways when the plug is in a first angular position with respect to the housing to provide a continuous airflow path from one vacuum zone to the vacuum source, and which cavity also communicates with the first and a second of the housing passageways when the plug is in a second angular position with respect to the housing to provide a continuous airflow path from said one vacuum zone and another vacuum zone to the vacuum source.

2. A vacuum holding system as defined in claim 1 wherein there is a series of defined angular positions at which the plug can be positioned with respect to the housing and the first and second angular positions are adjacent positions in the series.

3. A vacuum holding system as defined in claim 1 wherein the conically shaped portion of the housing through-opening has a surface in sliding engagement with the corresponding conically shaped portion of the plug when the plug is rotated with respect to the housing and a portion of the cavity of the plug is defined by a central bore extending into the plug from the outlet end of the housing and another portion of the cavity is defined by a cut-away portion of plug located between the plug central bore and the sliding surface of the housing through-opening.

4. A vacuum holding system as defined in claim 1 wherein the conically shaped portion of the housing through-opening has a surface in sliding engagement with a corresponding conically shaped portion of the plug when the plug is rotated with respect to the housing, and the radially extending passageways of the housing are arranged in a circumaxial series along the sliding surface of the through-opening.

5. A vacuum holding system as defined in claim 1 wherein there exists a third angular position of the plug with respect to the housing at which the central cavity of the plug communicates with none of the housing passageways to provide no airflow through the housing between a vacuum zone and the vacuum source.

6. A vacuum holding system as described in claim 1 wherein the valve further comprises indexing means cooperating between the plug and housing for releasably holding the plug in place at each of the angular positions with respect to the housing.

7. A vacuum holding system as defined in claim 6 wherein the indexing means includes a spring and plunger assembly and means defining a series of detents positioned circumaxially about the axis of plug rotation, the spring and plunger assembly including a plunger for slidably engaging the detent-defining means and of such size to be slidably received in each detent and including a spring for biasing the plunger toward the detent-defining means, one of the assembly and detent-defining means being associated with the housing and the other of the assembly and detent-defining means being associated with the plug whereby the plug is releasably held in place at an angular position with respect to the housing when the plunger is slidably received in one of the detents of the detent-defining means.

8. A vacuum defining means as defined in claim 6 wherein the detents are defined on a surface of the plug and the spring and plunger assembly is supported in the housing.

* * * * *